US005395221A

United States Patent [19]

Tucker, Jr. et al.

[11] Patent Number: 5,395,221

[45] Date of Patent: Mar. 7, 1995

[54] CARBIDE OR BORIDE COATED ROTOR FOR A POSITIVE DISPLACEMENT MOTOR OR PUMP

[75] Inventors: Robert C. Tucker, Jr., Brownsburg, Ind.; Melvin D. Mendenhall, Friendswood; Madapusi K. Keshavan, The Woodlands, both of Tex.

[73] Assignee: Praxair S.T. Technology, Inc., Danbury, Conn.

[21] Appl. No.: 32,933

[22] Filed: Mar. 18, 1993

[51] Int. Cl.[6] ..... F01C 1/10; F01C 21/00

[52] U.S. Cl. ..... 418/48; 418/178; 418/179

[58] Field of Search ..... 418/48, 178, 179

[56] References Cited

U.S. PATENT DOCUMENTS

| | | | |
|---|---|---|---|
| 3,071,489 | 1/1963 | Pelton et al. . | |
| 4,999,255 | 3/1991 | Jackson et al. | 428/552 |
| 5,075,129 | 12/1991 | Jackson et al. | 427/34 |
| 5,120,204 | 6/1992 | Mathewson et al. | 418/48 |

*Primary Examiner*—Richard A. Bertsch
*Assistant Examiner*—Charles G. Freay
*Attorney, Agent, or Firm*—Cornelius F. O'Brien

[57] ABSTRACT

A rotor for a positive displacement motor or pump in which the rotor is coated with a metal carbide and metal alloy coating or a metal boride and metal alloy coating to impart excellent wear-resistance and corrosion-resistance properties to the rotor when used in abrasive and/or corrosion resistance environmental.

16 Claims, 1 Drawing Sheet

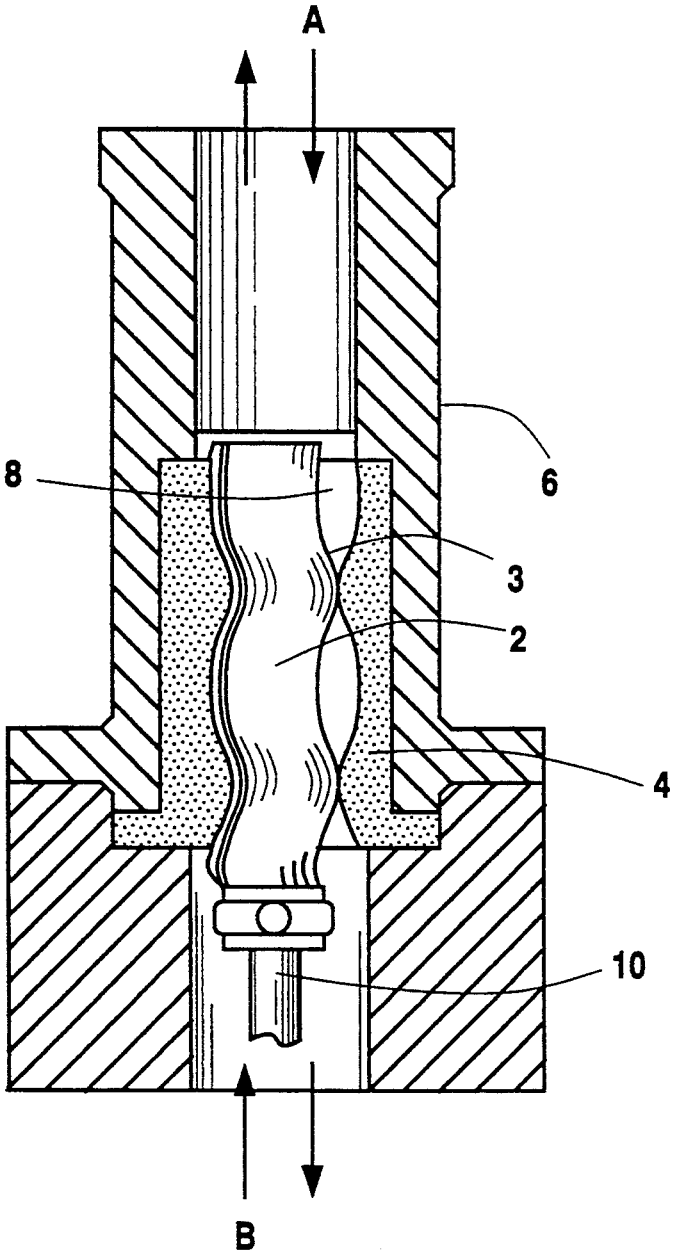
A
8
6
3
2
4
10
B

CARBIDE OR BORIDE COATED ROTOR FOR A POSITIVE DISPLACEMENT MOTOR OR PUMP

FIELD OF THE INVENTION

This invention relates to a rotor for use in a positive displacement motor or pump and wherein said rotor is coated with a metal carbide and/or metal boride coating to impart excellent wear-resistance and corrosion-resistance properties to the rotor when used in abrasive and/or corrosive environments.

BACKGROUND OF THE INVENTION

A Moineau type positive displacement device can be used as a motor or pump by designing the rotor and stator for the device with a particular shape such as a spiral-helix screw shape to provide a progressive cavity between the rotor and the stator. When operated as a pump, the rotor turns within the stator casing fluid to be moved along the progressive cavity from one end of the pump to the other. When operated as a motor, fluid is pumped into the progressive cavity of the device so that the force of the fluid movement causes the shaft to rotate within the stator. The rotational force can then be transmitted through a connecting rod and drive shaft. Thus the positive displacement device using a specifically designed rotor and stator can be used as a motor or pump depending whether the force of the fluid is pumped through the motor whereupon it functions as a motor or external force acts on the rotor and causes the fluid to move so that it functions as a pump.

In the most basic form of drilling oil and gas wells, a rig motor supplies power to the many lengths of pipe comprising the drill string, causing it to rotate and turn the drilling bit at the bottom of the hole. Turning the drill string from the surface results in a great deal of friction and torsional stress in the upper portion of the drill string. Friction between the drill pipe and the side of the well bore, together with the elastic stretch and twist in the drill pipe, cause an inconsistent weight to bear on the bit. This is harmful to the bit and can also result in metal fatigue failure in the drill string. Therefore, it is often advantageous to utilize a motor at the bottom of the hole as the motive force for the drilling bit, eliminating the need to rotate the drill pipe. This results in reduction of wear on the equipment, lowering of drilling weight requirements, simplification of bottom hole drilling assemblies, and improved cost effectiveness. Directional guidance control is also possible with such systems. Such a motor is less costly to run in many cases. A particular design of motor that is especially well suited to downhole applications is the positive displacement motor discussed above in which a screw-shaped rotor is turned within a stator by a fluid which is pumped through the motor under pressure. The rotational force is then transmitted through a connecting rod and drive shaft to the bit. In motors of this kind, the rotor is generally made of alloy steel bar having a central hole for fluid passage and shaped as a spiral helix and the stator is a length of tubular steel lined with a molded-in-place elastomer. The elastomer is formulated to resist abrasion and deterioration due to hydrocarbons and is shaped as a spiral cavity, similar to but not identical with, the spiral shape of the rotor. In addition to having a basic spiral shape, the rotor may be fluted, with as many as 10 or more flutes. The mating stator will thin have as many flutes, plus one. With proper mutual shaping, the rotor and stator form a continuous seal along their matching contact lines and also form a cavity or cavities that progress through the motor from one end to the other end as the rotor turns. The efficiency of these motors is highly dependent on precise dimensional matching of the rotor and stator profiles.

In operation, drilling fluid or "mud" (usually a mixture of water and/or oil, clay, weighting materials, and some chemicals formulated to fluidize the cuttings made by the drilling bit and to contain formation pressures) is pumped down the length of the motor between the rotor and the stator, causing the rotor to turn and drive the bit. The solids content of the drilling fluid acts to abrade the components of the positive displacement motor, particularly the rotor, while the aqueous environment and chemical substances present often tend to promote corrosion of the rotor. Wear and corrosion of the rotor tend to destroy the designed-in seal between rotor and stator and degrade the performance of the motor to the point that it becomes necessary to remove it from the hole and rework or replace it. Rough, angular, or irregular surface areas that develop on the rotor due to its erosion or corrosion can abrade or cut the mating elastomer, thus degrading the motor operation even when the damage to the rotor is within limits that would be tolerable were it not for the damage to the stator elastomer. While a certain amount of replacement is unavoidable and might have to be done anyhow to change bits to conform to the properties of the various strata through which the hole is drilled, premature wear or corrosion entails, in addition to the cost of reworking or replacing the motor components, the additional expense of pulling the drill string prematurely from the hole. Chrome plate is often applied to the rotor surface to protect it from abrasion and corrosion, but this is not usually satisfactory because it does not have adequate abrasion resistance and because liquid penetration of the chrome plate permits corrosion of the rotor base material. Furthermore, it is difficult to obtain a uniform thickness of chrome plate on the rotor surface because the complex geometry of the rotor causes non-uniform electric fields to develop around the rotor during plating resulting in development of an uneven coating thickness that distorts the designed precise geometrical matching of the rotor with the stator and degrades the efficiency of the motor even when new. In other attempts to protect the rotor from wear and corrosion, nickel-based alloys have been applied to the rotor surfaces by deposition techniques such as plasma spray or other thermal spray device. Coatings of this type may be potentially superior in some ways to chrome plate in erosion and corrosion resistance, but require densification by fusing, hot isostatic pressing, or some other thermal method to seal their inherent porosity so that the rotor substrate is isolated from the corrosive surroundings. Any heat treatment applied to the rotors during the processing of the coating can distort the shape of the rotors with the same resultant mismatch and efficiency losses mentioned above.

It is an object of the present invention to provide a coating for a rotor of a positive displacement motor or pump that has excellent wear ant corrosion resistance characteristics.

It is another object of the present invention to provide a metal carbide and/or metal boride coating for helical shaped rotors for use in positive displacement pumps or motors.

It is another object of the present invention to provide a rotor for a positive displacement motor or pump having an excellent wear-resistance and corrosion-resistance coating.

It is another object of the present invention to provide a cost effective coating for rotors that will extend the useful life of positive displacement devices using such rotors.

SUMMARY OF THE INVENTION

The invention relates to a coated rotor for use in a positive displacement apparatus selected from the group consisting of a motor and a pump; said coated rotor having a coating selected from the group consisting of metal carbide with a metal or metal alloy binder, metal boride with a metal or metal alloy binder and mixed metal carbide and borides with metal or metal alloy binders thereof; and wherein the coating contains at least 65 weight percent carbide and boride and has a hardness of a least 900 HV.3, preferably at least 950 HV.3 and most preferably at least 1000 HV.3. Preferably the carbide and/or boride should be present in the coating in an amount greater than 75 weight percent and more preferably greater than 90 weight percent with the balance comprising a metal or metal alloy. The thickness for the coating can vary depending on the specific coating selected and on the intended use of the positive displacement apparatus. Generally a thickness of at least 0.0005 inch would be required while a thickness of at least 0.002 inch would be preferred.

The grain or particle size of the metal or metal alloy in the coating should preferably be smaller than the size of particles that are contained in a fluid that is to be fed through the motor. This will effectively insure that the metallic phase will not be eroded and that the carbide and/or boride particles or grains of the coating will remain in the coating and not be dislodged by the fluid. Preferably, the average grain size of the metal carbide, metal boride, and the metal or metal alloy in the coating should be less than 75 microns, more preferably less than 50 microns, and most preferably less than 25 microns. Small carbide and/or boride size will excessive abrasion of the mating polymeric material.

It has been found that the application of specific corrosion-resistant metal carbide or boride coatings to the surfaces of the rotors can provide effective enhancement of the service lifetimes of these motors or pumps making their utilization much more practical and cost effective. Suitable coatings for this invention are tungsten chromium carbide-nickel coatings that have improved corrosion resistance because of the presence of both chromium and nickel. A particular tungsten chromium carbide-nickel coating which contains chromium-rich particles having at least 3 times more chromium than tungsten and wherein said chromium-rich particles comprise at least 4.5 volume percent of the coating is disclosed in U.S. Pat. No. 4,999,255 and U.S. Pat. No. 5,075,129. The disclosures of U.S. Pat. No. 4,999,255 and U.S. Pat. No. 5,075,129 are incorporated herein by reference as if the disclosures were recited in full text in this specification. Another particular tungsten chromium carbide-nickel coating for use in this invention is described in U.S. Pat. No. 3,071,489 which discloses a tungsten, chromium carbide-nickel coating containing between about 60 and about 80 weight percent of tungsten carbide, between about 14 and about 34 weight percent: chromium carbide, some or all of which carbides may be in the form of mixed tungsten-chromium carbides, and between about 4 and about 8 weight percent nickel base alloy. The disclosure of U.S. Pat. No. 3,071,489 is incorporated herein by reference as if the disclosures were recited in full text in this specification.

There are many means known to those skilled in the art by which a substrate may be coated with a wear-resistant coating of the kind discussed above. The most appropriate means for coating rotors of the complex shape described above is one of the family of processes known collectively as thermal spray processes, which includes detonation gun deposition, oxy-fuel flame spraying, high velocity oxy-fuel deposition, and plasma spray. It is characteristic of the coatings deposited by this family of processes that they contain interconnected porosity that may be fine or coarse depending on the process and process parameters used. Any potential internal or interface corrosion problems caused by the presence of this porosity can be ameliorated to further enhance the corrosion protection that the coating provides the rotor body by impregnating the said porosity with a corrosion resistant sealant material, commonly an organic material as, for example, a polymeric material such as an epoxy that polymerizes in place after being introduced into the porosity in an unpolymerized state. Such a corrosion resistant sealant would be desirable on the surface of a rotor because of the protection it provides against liquid corrosion, but cannot be used on an uncoated rotor because it would almost immediately be scraped or eroded away. When contained within the fine interconnected porosity of a high quality thermal spray coating, however, the polymeric sealant is protected from this action by the surrounding hard coating material. Thus, in addition to providing wear resistance beyond that of which the rotor base material is capable of providing and being in themselves resistant to corrosion, the corrosion wear-resistant metal carbide and/or boride coatings of this invention provide an invaluable support network for the additional corrosion protection of a polymeric coating or sealant.

A preferred sealant for use with the coating of this invention is UCAR 100 sealant which is obtained from Praxair Surface Technologies, Inc. UCAR is a trademark of Union Carbide Corporation.

Corrosion or erosion of the rotor is undesirable in itself because of the geometrical abnormality that it causes, but it is even more damaging in that irregular or sharp edges of corroded or eroded areas can extensively damage the mating elastomeric stator material by cutting it. The erosion and corrosion resistant coatings of this invention are intended to prevent development of such irregular or sharp-edged areas of damage. However, even the most wear-resistant coatings finished to the highest degree of smoothness will wear to some degree and lose their smoothness. It is characteristic of the metal carbide and metal boride coatings of the invention that they are composed of particles of varying degrees of hardness and wear resistance; such particle-to-particle variation is effective in being able to resist the mechanical stresses they are exposed to by virtue of their being attached to the surface of the rapidly turning rotor. As the surface of the coating is slowly eroded by the flowing mud, it is inevitable that the softer and less wear-resistant particles of the coating will be eroded first and that the harder particles will be exposed to a degree. If the harder particles are large or angular, they can act as cutting teeth on the mating stator material and cut it, thus exacerbating the damage and increasing the overall deleterious effect on the motor performance.

It is highly desirable, therefore, that the grain size of the particles in the coating be finely divided to an average size of less than 75 microns, and preferably less than 50 microns as stated above.

The preferred coatings of this invention are tungsten chromium carbide-cobalt coatings containing 2–14 wt. % cobalt, or cobalt alloy with the balance mixed or alloyed tungsten chromium carbides, and tungsten chromium carbide-nickel coating containing between 60 to 80 weight percent of tungsten carbide, between 14 and 34 weight percent chromium carbide and between 4 and 8 weight percent nickel or nickel base alloy.

BRIEF DESCRIPTION OF THE DRAWING

The sole drawing in the application is a side cross-sectional view of a single-screw positive displacement device. This drawing shows a spiral rotor 2 coated with a coating 3 of this invention disposed within an internal-helix stator 4 assembled within a housing. Between rotor 2 and stator 4 are progressive cavities 8. If fluid is forced through the device in the direction A, the rotor is forced to turn and the device acts as a motor. Preferably, the rotor will have a central opening when functioning as a motor. Connected to rotor 2 is a shaft 10 that could be used to drive a tool bit or the like. If the rotor is turned by an external drive system rotating the shaft, fluid is forced through the device in direction B and it acts as a pump; i.e., as the shaft 10 rotates, rotor 2 rotates and thereby pumps a fluid to the progressive cavity 8, whereupon the fluid is extracted at the end of the rotor 2.

EXAMPLE 1

In a flow test that simulated the operation of a positive displacement motor, a helical spiral rotor was coated with chromium electroplate of the quality normally used on rotors and pressurized at 50 psi with a flowing solution of 300,000 parts per million (ppm) of calcium chloride for 30 hours. The rotor was examined and revealed severe corrosion. The corrosion pattern, which started as small pits, appeared to be similar to the corrosion pattern exhibited by chrome plated rotors that had been employed in actual drilling operations. A tungsten chromium carbide-nickel coating containing about 24 weight percent chromium carbide, and about 8 weight percent nickel-based alloy with the balance tungsten carbide, in which the coating particles were finely divided to an average size of 50 microns or less, was deposited on an identical rotor. The rotor was pressurized at 50 psi with a flowing solution of 100,000 ppm of calcium chloride for 200 hours and then for an additional 200 hours with a flowing solution of 300,000 ppm calcium chloride on a schedule that incorporated a still additional 400 hours of contact with the calcium chloride solution without flow. The rotor was examined and showed no visible degradation. The rotor did pick up a small amount elastomer from the mating stator, but this was easily removed and did not degrade the performance of the motor.

EXAMPLE 2

Rotating beam fatigue tests as described on 369 of volume 8 of the ninth edition of Metals Handbook, published by ASM International, Metals Park OH, 1985, were conducted with sample pieces immersed in a solution containing 300,000 ppm calcium chloride. The test pieces had a tungsten carbide-cobalt-chromium coating containing about 83 weight percent tungsten carbide, about 4 weight percent chromium and the balance cobalt-based alloy deposited on a substrate AISI type 4140 steel of hardness 34 HRC. The coated specimens survived more than 6,000,000 cycles in an alternating stress test with a 50,000 psi maximum stress. Uncoated AISI type 4140 steel of similar hardness failed in less than 2,000,000 cycles even when the calcium chloride concentration was reduced to 300 ppm.

EXAMPLE 3

A rotating beam fatigue test was conducted with samples immersed in a solution containing 300,000 ppm calcium chloride as described in Example, 2, for a target of 6,000,000 cycles. The test samples consisted of a substrate of AISI type 4140 steel having a hardness of 34 HRC coated with a tungsten chromium carbide-nickel coating containing about 24 weight percent chromium carbide, and about 7 weight percent nickel-based alloy with the balance tungsten carbide. The coated samples survived more than 6,000,000 cycles and one sample survived more than 12,000,000 cycles. Uncoated AISI type 4140 steel of similar hardness failed in less than 2,000,000 cycles even when the calcium chloride concentration was reduced to 300 ppm.

EXAMPLE 4

A 6 inch diameter rotor was coated over 128 inches of its length with a 0.006 to 0.009 inch coating of a tungsten chromium carbide-nickel coating containing about 24 weight percent chromium carbide, and about 7 weight percent nickel based alloy with the balance tungsten carbide. The coating was sealed with an epoxy sealant of UCAR-100, and finished by belt sanding. The rotor was installed in a motor and used in an actual oil drilling operation. After running for 105 hours in a K-Mg-Cl drilling fluid, the surface of the rotor was in pristine condition with no sign of corrosion of the coating or the underlying steel rotor body. The thickness of the coating had been reduced by 0.0015 to 0.0020 inch and the internal diameter of the mating stator had increased by about only 0.015 inch. By contrast, a conventional chrome plated rotor lasted only 18 hours in the same service before it had to be replaced because it was deeply corroded.

EXAMPLE 5

A rotor similar to that in Example 4, but with a tungsten chromium carbide-cobalt coating containing about 13 weight percent cobalt, 4 weight percent chromium, 5 weight percent carbon, and the balance tungsten, was also tested in an actual oil drilling operating under the same conditions as in Example 4. After running for a total of 350 hours, pitting of the surface of the coating was observed. Nonetheless, the life of the rotor was much longer than the convention chrome plated rotor (typically 18 hours in the same service).

It will be understood that various changes in the details, materials and arrangements of parts which have been described herein may be made by those skilled in the art within the principle and scope of the invention as expressed in the claims.

What is claimed:

1. A positive displacement device comprising a spiral-helix screw shaped coated rotor disposed within a tubular stator lined with an elastomer inner surface; said coated rotor having a coating selected from the group consisting of a metal carbide-with a metal or metal alloy, a metal boride with a metal or metal alloy and mixtures thereof; and wherein the coating contains at least 65 weight per cent metal carbide for the metal carbide coating and 65 weight percent metal boride for the metal boride coating and said coating has a hardness of at least 900 HV.3.

2. The positive displacement device of claim 1 wherein said device is a motor.

3. The positive displacement device of claim 1 wherein said device is a pump.

4. The positive displacement device of claim 1 wherein the coating is a tungsten, chromium carbide with a metal alloy selected the group consisting of cobalt, cobalt alloy, nickel and nickel alloy.

5. The positive displacement device of claim 4 wherein the metal or metal alloy has a grain size of less than 75 microns.

6. The positive displacement device of claim 4 wherein the coating is a tungsten, chromium carbide-nickel or nickel alloy coating containing between 60 and 80 weight percent tungsten carbide, between 14 and 34 weight percent chromium carbide and between 4 and 8 percent nickel or nickel-base alloy.

7. The positive displacement device of claim 4 wherein the coating is a tungsten chromium carbide-cobalt or cobalt alloy coating.

8. The positive displacement device of claim 4 wherein the grain size of the metal carbide is less than 75 microns and the grain size of the metal or metal alloy is less than 75.

9. The positive displacement device of claim 4 wherein the metal carbide is greater than 75 weight percent of the coating.

10. The positive displacement device of claim 9 wherein the metal carbide is greater than 90 weight percent of the coating.

11. The positive displacement device of claim 10 wherein the hardness is at least 950 HV.3.

12. The positive displacement device of claim 10 wherein the grain size of the metal or metal alloy is less than 50 microns.

13. The positive displacement device of claim 4 wherein the coating is a tungsten, chromium carbide-nickel or nickel alloy coating containing about 24 weight percent chromium carbide, about 8 weight percent nickel or nickel alloy with the balance tungsten carbide.

14. The positive displacement device of claim 13 wherein the grain size of the nickel or nickel alloy is less than 50 microns and the hardness is at least 950 HV.3.

15. The positive displacement device of claim 4 wherein the coating is a tungsten chromium carbide-cobalt or cobalt alloy coating containing about 83 weight percent tungsten carbide, about 4 weight percent chromium with the balance cobalt or a cobalt alloy.

16. The positive displacement device of claim 15 wherein the grain size of the cobalt or cobalt alloy is less than 50 microns and the hardness is at least 950 HV.3.

* * * * *